US010838368B2

(12) United States Patent
Nomura

(10) Patent No.: US 10,838,368 B2
(45) Date of Patent: Nov. 17, 2020

(54) TIMEPIECE, TIMEPIECE SYSTEM, AND METHOD OF CONTROLLING TIMEPIECE

(71) Applicant: SEIKO INSTRUMENTS INC., Chiba (JP)

(72) Inventor: Takayuki Nomura, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 227 days.

(21) Appl. No.: 15/973,884

(22) Filed: May 8, 2018

(65) Prior Publication Data

US 2019/0025766 A1 Jan. 24, 2019

(30) Foreign Application Priority Data

Jul. 18, 2017 (JP) ..... 2017-139249

(51) Int. Cl.
*G04C 3/14* (2006.01)
*G04C 9/08* (2006.01)
*G04G 21/04* (2013.01)

(52) U.S. Cl.
CPC ..... *G04C 9/08* (2013.01); *G04C 3/146* (2013.01); *G04G 21/04* (2013.01)

(58) Field of Classification Search
CPC . G04C 9/08; G04C 3/14; G04C 3/146; G04G 21/04
See application file for complete search history.

(56) References Cited

U.S. PATENT DOCUMENTS 4,470,707 A * 9/1984 Chambon ..... G04C 9/00 368/187
5,619,478 A * 4/1997 Mutoh ..... G04B 45/0061 368/223
9,989,925 B2 * 6/2018 Wautier ..... G04C 3/001
10,095,189 B2 * 10/2018 Masserot ..... G04G 5/00
2015/0362893 A1 * 12/2015 Masserot ..... G04G 5/00 368/4

OTHER PUBLICATIONS

Abstract, Publication No. JP 2016-142626, Publication date Aug. 8, 2016.

* cited by examiner

*Primary Examiner* — Sean Kayes
(74) *Attorney, Agent, or Firm* — Adams & Wilks

(57) ABSTRACT

There is provided a timepiece which includes a movable pointer, an acquisition unit which acquires information on a movable range corresponding to at least a portion of a movable range of the movable pointer and acquires information indicating a target position to which the pointer is to be moved, a control unit which compares the target position with the movable range and determines a movement direction of the pointer based on the comparison result, and a drive unit which drives the pointer in the determined movement direction.

11 Claims, 8 Drawing Sheets

| MOVABLE RANGE | PROHIBITION AREA START POSITION | PROHIBITION AREA END POSITION |
|---|---|---|
| 270° ~30° | 30° | 270° |

g1

| |
|---|
| POSITION OF FIRST POINTER |
| POSITION OF SECOND POINTER |
| POSITION OF THIRD POINTER |

g2

| MOVABLE RANGE | INSTRUCTED VALUE |
|---|---|

| MOVABLE RANGE OF FIRST POINTER | INSTRUCTED VALUE OF FIRST POINTER | MOVABLE RANGE OF SECOND POINTER | INSTRUCTED VALUE OF SECOND POINTER |
|---|---|---|---|

FIG. 12
| | | | |
|---|---|---|---|
| FIRST PRESET VALUE | FIRST MOVABLE RANGE | FIRST PROHIBITION AREA START POSITION | FIRST PROHIBITION AREA END POSITION |
| SECOND PRESET VALUE | SECOND MOVABLE RANGE | SECOND PROHIBITION AREA START POSITION | SECOND PROHIBITION AREA END POSITION |
| THIRD PRESET VALUE | THIRD MOVABLE RANGE | THIRD PROHIBITION AREA START POSITION | THIRD PROHIBITION AREA END POSITION |
FIG. 13
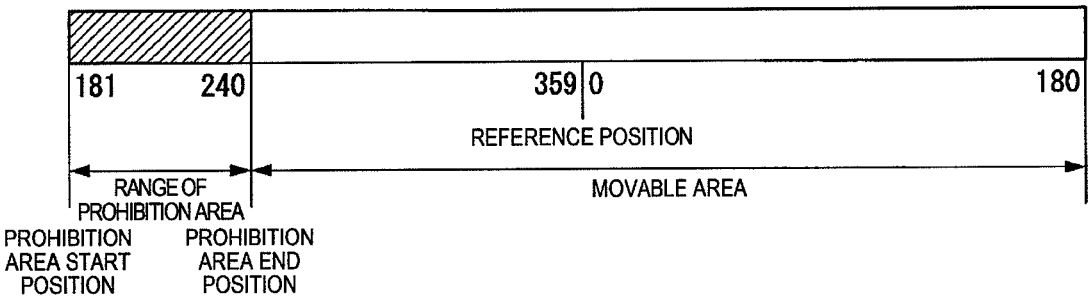
FIG. 14
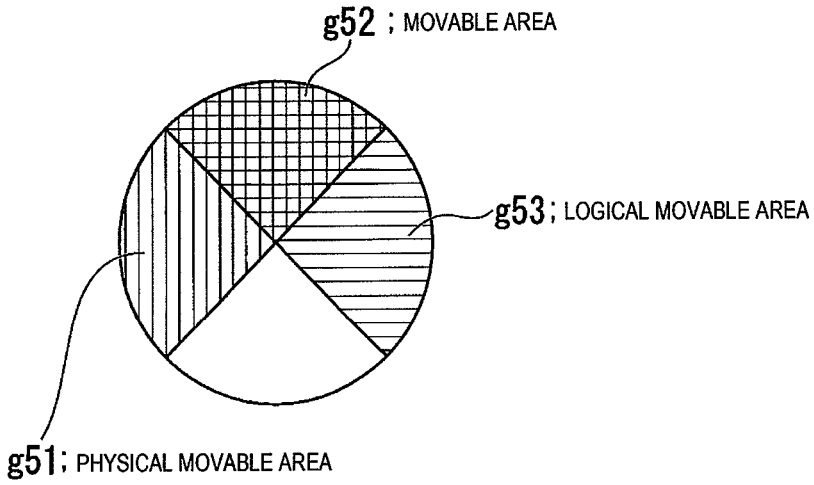

TIMEPIECE, TIMEPIECE SYSTEM, AND METHOD OF CONTROLLING TIMEPIECE

BACKGROUND OF THE INVENTION

Field of the Invention

The present invention relates to a timepiece, a timepiece system, and a method of controlling a timepiece.

Background Art

A timepiece which controls a hand (pointer) according to external control irrespective of the clocked time has been proposed. Such a timepiece includes for example, an information unit and an electronic timepiece unit. For example, the information unit has a wireless communication function and is a smart watch as an electronic timepiece in which an application program can be installed. The electronic timepiece unit controls the hand according to a control signal output from the information unit. In such a timepiece, in a case where the electronic timepiece unit has completed control of the hand, matters that the control of the hand has been completed are output to the transmission source of the control signal, including a position of the hand (see, for example, JP-A-2016-142626).

However, in the technique described in JP-A-2016-142626, there is a concern that an instruction of a rotation direction made from a transmission source may not sufficiently reflect an actual situation of the pointer. For that reason, it is difficult to optimally control a drive request to the pointer within a movable range of the pointer.

SUMMARY OF THE INVENTION

Some or all aspects according to the invention provide a timepiece capable of properly driving a hand in response to a drive request to the hand within a predetermined range, a timepiece system, and a method of controlling the timepiece.

According to an aspect of the invention, there is provided a timepiece 1 which includes a movable pointer (pointer 60; first pointer 60A, second pointer 60B, third pointer 60C), an acquisition unit (communication circuit 206) which acquires information on a movable range (for example, from position D to position C) corresponding to at least a portion of a movable range (0° to 359° or 0 to 359 steps) of the movable pointer and acquires information indicating a target position (for example, position B) to which the pointer is to be moved, a control unit (main control circuit 204 and drive control circuit 44) which compares the target position with the movable range and determines a movement direction of the pointer based on the comparison result, and a drive unit (drive pulse generation circuit 46A, drive pulse generation circuit 46B, drive pulse generation circuit 46C, first motor 47A, second motor 47B, and third motor 47C) which drives the pointer in the determined movement direction.

In the timepiece according to the aspect of the invention, the control unit may calculate the comparison result so that the drive unit does not drive the pointer outside the movable range.

In the timepiece according to the aspect of the invention, when at least one of one end (for example, prohibition area end position) and the other end (for example, prohibition area start position) of the movable range is included between a movement start position and the target position in a predetermined one direction (for example, normal rotation direction) from the movement start position, the control unit may determine the movement direction as a movement direction to another direction (for example, a reverse rotation direction) different from the predetermined one direction.

In the timepiece according to the aspect of the invention, the control unit may determine the movement direction within a range obtained by adding the movable range of the pointer with respect to the position in a case where at least one of the one end of the movable range, the other end of the movable range, and the target position straddles a reference position (for example, a position of 0° or a position of 0 step) when viewed from the movement start position when it is intended to move the pointer in a predetermined one direction from the movement start position.

In the timepiece according to the aspect of the invention, the acquisition unit may acquire a first target position (first instructed value) which is the target position, and a second target position (second instructed value) which is requested after the first target position and is the target position, and the control unit may control the drive unit so that the pointer is driven based on the second movement direction before the pointer reaches the first target position, based on a first movement direction calculated based on the first target position and a second movement direction calculated based on the second target position.

In the timepiece according to the aspect of the invention, the acquisition unit acquires information in which the target position and the movable range are combined.

In the timepiece according to the aspect of the invention, a regulation unit (for example, a stopper, a main control circuit 204, and a drive control circuit 44) which regulates a rotation range of the pointer may be further included, and the acquisition unit may be a communication unit that transmits and receives information to and from an electronic device 90 having a communication function and the control unit may determine a range in which the movable range acquired by the acquisition unit overlaps a rotation range regulated by the regulation unit as a movable range of the pointer.

In the timepiece according to the aspect of the invention, the control unit may notify a notification signal in a case where the target position is outside the movable range.

In the timepiece according to the aspect of the invention, storing units 14 and 45 each of which stores a plurality of the movable ranges may be further included, and the acquisition unit may be a communication unit which transmits and receives information to and from an electronic device having a communication function and may acquire a selection signal indicating whether the movable range is one of the plurality of movable ranges, and the control unit may select one of the plurality of movable ranges according to the selection signal.

In the timepiece according to the aspect of the invention, the control unit may compare a prohibition area start position which is an end position of the movable range with the movement start position, correct the prohibition area start position by adding the movable range of the pointer to the prohibition area start position and set the prohibition area start position as a post-comparison prohibition area start position in a case where the prohibition area start position is a position before the movement start position as a result of the comparison, and set the prohibition area start position as the post-comparison prohibition area start position without correcting the prohibition area start position in a case where the prohibition area start position is a position ahead of the movement start position as a result of the comparison, compare the target position and the movement start position, correct the target position by adding the movable range of the pointer to the target position and set the target position as a post-comparison target position in a case where the target position is a position before the movement start position as a result of the comparison, and set the target position as the post-comparison target position without correcting the target position in a case where the target position is a position ahead of the movement start position as a result of the comparison, and compare the post-comparison target position with the post-comparison prohibition area start position, determine that the post-comparison target position is to be moved in a normal direction in a case where the post-comparison target position is a position before the post-comparison prohibition area start position as a result of the comparison, and determine that the post-comparison target position is to be moved in a reverse direction in a case where the post-comparison target position is a position ahead of the post-comparison prohibition area start position as a result of the comparison.

In order to achieve the object described above, according to another aspect of the invention, there is provided a timepiece system (2) which includes a timepiece (1) which includes a movable pointer (pointer 60; first pointer 60A, second pointer 60B, and third pointer 60C), a communication unit (communication circuit 206) which acquires information on a movable range corresponding to at least a portion of a movable range (0° to 359° or 0 to 359 steps) of the movable pointer and acquires information indicating a target position (for example, position B) to which the pointer is to be moved, a control unit (main control circuit 204 and drive control circuit 44) which compares the target position with the movable range and determines a movement direction of the pointer based on the comparison result, and a drive unit (drive pulse generation circuit 46A, drive pulse generation circuit 46B, drive pulse generation circuit 46C, first motor 47A, second motor 47B, and third motor 47C) which drives the pointer in the determined movement direction and an electronic device 90 provided with a communication unit 91 which transmits information indicating the movable range and information indicating the target position.

In the timepiece system according to the other aspect of the invention, the timepiece may further include storing units 14 and 45 each of which stores a plurality of the movable ranges, and the control unit of the timepiece may transmit the plurality of movable range stored by the storing units to the electronic device via the communication unit, and the electronic device may select a desired movable range from among the plurality of movable ranges received from the timepiece and transmit the selected movable range to the timepiece.

In order to achieve the object described above, according to still another aspect of the invention, there is provided a method of controlling a timepiece which includes acquiring information on a movable range corresponding to at least a portion of a movable range of a movable pointer by an acquisition unit (Step 1), acquiring information indicating a target position to which the pointer is to be moved by the acquisition unit (Step 2), comparing the target position and the movable range and determining a movement direction of the pointer based on the comparison result by a control unit (Step S5 to Step S12), and driving the pointer in the determined movement direction by a drive unit.

According to the invention, it is possible to properly drive a hand according to a drive request to the hand within a predetermined range. With this, it is possible to improve followability for continuous drive requests. It is possible to prevent the pointer from operating beyond a movable range in response to the drive request.

BRIEF DESCRIPTION OF THE DRAWINGS

FIG. 12 is a table illustrating another example of information stored in the storing unit and a storing unit according to the embodiment.

FIG. 13 is a view illustrating an example of another movement direction of the pointer.

FIG. 14 is a diagram illustrating an example of a case where the electronic device further transmits the movable range when the movable range of the pointer is regulated in advance.

DETAILED DESCRIPTION OF THE INVENTION

Hereinafter, embodiments of the invention will be described with reference to the drawings.

Figure 1:
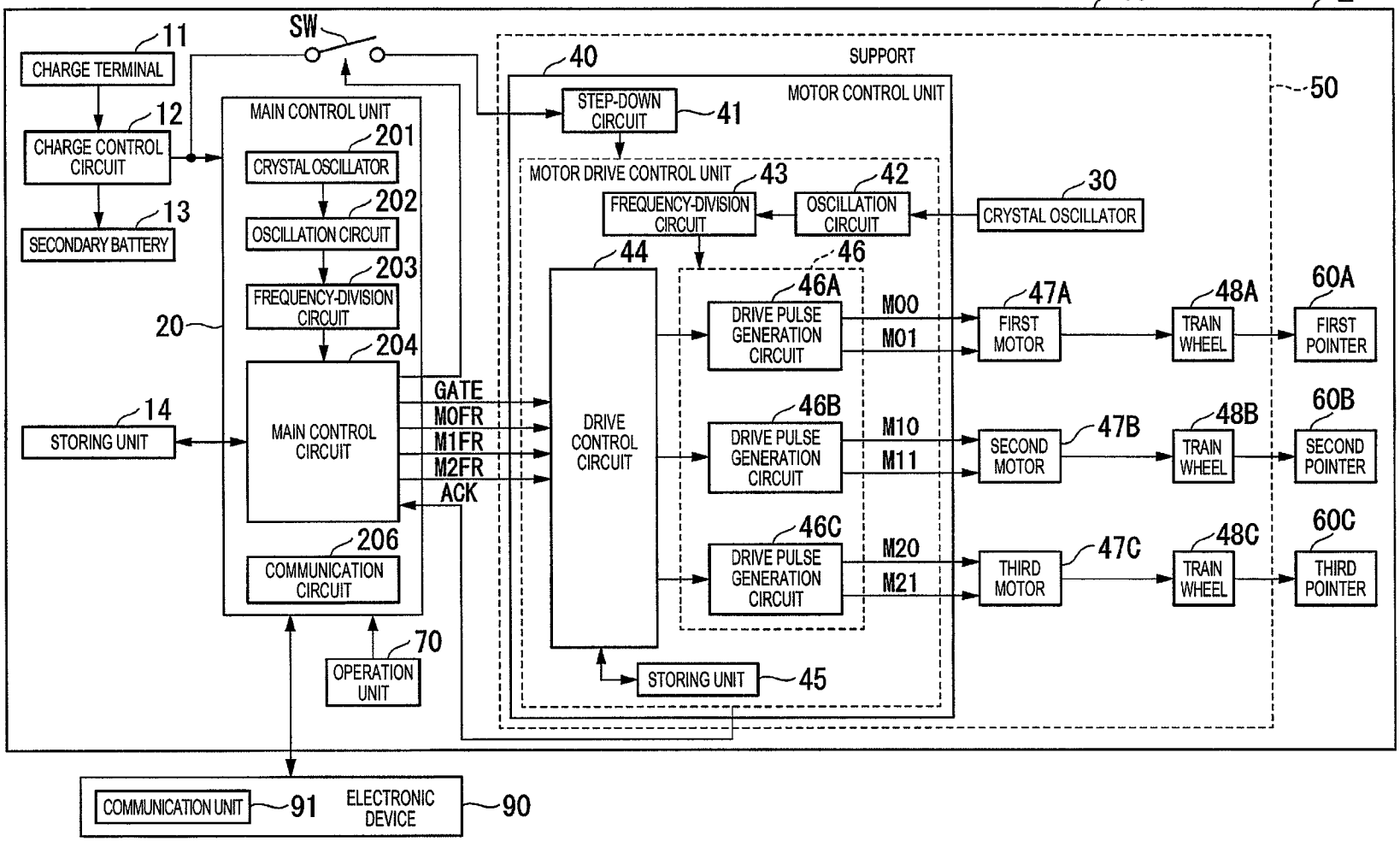
FIG. 1 is a block diagram illustrating an example of a configuration of a timepiece according to an embodiment.

FIG. 1 is a block diagram illustrating an example of a configuration of a timepiece system 2 according to the embodiment. As illustrated in FIG. 1, the timepiece system 2 is configured with a timepiece 1 and an electronic device 90. The timepiece 1 includes a charge terminal 11, a charge control circuit 12, a secondary battery 13, a storing unit 14, a switch SW, a main control unit 20, a support 50, a first pointer 60A, a second pointer 60B, a third pointer 60C, and an operation unit 70. In a case where it is not intended to specify one of the first pointer 60A, the second pointer 60B, and the third pointer 60C, the pointers are collectively referred to as a pointer 60. In the following example, an example in which the pointer 60 is attached so as to be movable in a rotation direction will be described.

The main control unit 20 includes a crystal oscillator 201, an oscillation circuit 202, a frequency-division circuit 203, a main control circuit 204 (control unit), and a communication circuit 206 (acquisition unit).

The support 50 includes a crystal oscillator 30, a motor control unit 40, a first motor 47A, a second motor 47B, a third motor 47C, a train wheel 48A, a train wheel 48B, and a train wheel 48C. In a case where it is not intended to specify one of the first motor 47A, the second motor 47B, and the third motor 47C is not specified, the pointers are collectively referred to as a motor 47. In a case where it is not intended to specify one of the train wheel 48A, the train wheel 48B, and the train wheel 48C, the train wheels are collectively referred to as a train wheel 48.

The motor control unit 40 includes an oscillation circuit 42, a frequency-division circuit 43, a drive control circuit 44 (control unit), a storing unit 45, and a pulse generation circuit 46. The pulse generation circuit 46 includes a drive pulse generation circuit 46A, a drive pulse generation circuit 46B, and a drive pulse generation circuit 46C.

The electronic device 90 includes a communication unit 91. The electronic device 90 further includes an operation unit (not illustrated), a control unit (not illustrated), a storing unit (not illustrated), a display unit (not illustrated), a global positioning system (GPS), and the like.

The timepiece 1 presents the time using the first pointer 60A to third pointer 60C at the time of clocking the time. The timepiece 1 communicates with the electronic device 90 via a wireless network and transmits and receives information. The timepiece 1 receives a movable range and an instructed value with respect to the pointer 60 from the electronic device 90, and controls driving of the pointer 60 so as not to straddle outside the movable range (which is a prohibition area in which movement is prohibited) of the pointer 60 from a movement start position to a target position according to the received movable range and the instructed value. The instructed value is, for example, a moving speed, a heart rate or the like, and is information (angle from the reference position, the number of steps from the reference position) indicating the target position of the pointer 60. The movable range is a movable range of the pointer 60.

The electronic device 90 is a device having a communication function, for example, a smartphone, a tablet terminal, a portable game device, a computer, or the like. The electronic device 90 transmits transmission information of the movable range and the instructed value to the timepiece 1 via a network. The timing at which the electronic device 90 transmits the transmission information is the predetermined timing or any timing.

The substrate (base) 10 is a base to which the main control unit 20, the support 50, and the like are attached. The charge terminal 11, the charge control circuit 12, the secondary battery 13, the main control unit 20, and the support 50 are attached to the substrate 10.

The charge terminal 11 is a terminal that receives supply of power from the outside, and is, for example, a universal serial bus (USB) terminal. The charge terminal 11 supplies supplied power to the charge control circuit 12.

The charge control circuit 12 charges the secondary battery 13 with power supplied from the charge terminal 11. The charge control circuit 12 supplies power stored in the secondary battery 13 to the main control unit 20 and the motor control unit 40 attached to the support 50.

The secondary battery 13 is, for example, a lithium ion polymer battery.

The storing unit 14 stores the movable range and the instructed value transmitted by the electronic device 90. The storing unit 14 may store the movable range of the pointer 60 in advance.

The main control unit 20 controls each component of the timepiece 1. The main control unit 20 acquires an operation result of the operation unit 70 operated by the user, and controls each component of the timepiece 1 according to the acquired operation result. The main control unit 20 generates an instruction signal based on the movable range and the instructed value transmitted by the electronic device 90 and outputs the generated instruction signal to the drive control circuit 44.

The crystal oscillator 201 is a passive element used for oscillating the first frequency from mechanical resonance by utilizing piezoelectric phenomenon in crystal. Here, the first frequency is, for example, 100 MHz.

The oscillation circuit 202 is a circuit that realizes an oscillator by being combined with the crystal oscillator 201, and outputs the generated signal of the first frequency to the frequency-division circuit 203.

The frequency-division circuit 203 divides a signal of the first frequency output from the oscillation circuit 202 into a desired frequency and outputs the frequency-divided signal to the main control circuit 204.

The main control circuit 204 operates at the timing of the signal based on the first frequency. The main control circuit 204 is, for example, a central processing unit (CPU) for a portable terminal and a wearable terminal and is, for example, a CPU using an ARM architecture. The main control circuit 204 and the drive control circuit 44 are connected by two control lines GATE and ACK and three signal lines M0FR, M1FR, and M2FR. An instruction signal for the first pointer 60A is output to the M0FR signal line. An instruction signal for the second pointer 60B is output to the M1FR signal line. An instruction signal for the third pointer 60C is output to the M2FR signal line. The main control circuit 204 changes signal levels of the M0FR signal line, the M1FR signal line, and the M2FR signal line during a period in which the GATE signal line is at, for example, the high (H) level and outputs an instruction signal to the drive control circuit 44. The GATE signal is a timing defining signal that distinguishes the drive timing of each motor from other timings and defines the drive timing of each motor. On the ACK signal line, a signal indicating a result of the drive control circuit 44 receiving the signal is output from the drive control circuit 44 to the main control circuit 204. For example, in a case where the signal is correctly received, the signal level of the ACK signal line is the H level, and when the signal is not correctly received, the signal level of the ACK signal line is the low (L) level.

The main control circuit 204 stores the movable range and the instructed value transmitted by the electronic device 90 in the storing unit 14. The main control circuit 204 determines whether to rotate the pointer 60 in normal rotation or reverse rotation according to the stored movable range and instructed value and a position of the hand to be grasped. Based on the determined result, the main control circuit 204 generates an instruction signal for driving the motor for each pointer and outputs the generated instruction signal to the drive control circuit 44 for each pointer. A determination method of a rotation direction of the motor 47 will be described later. The main control circuit 204 can grasp the position of the hand by being provided with a function of a hand position counter that counts information indicating the number of drive pulses of the pointer included in the instruction signal output to the drive control circuit 44. For example, the main control circuit 204 can acquire the drive pulse generated by the pulse generation circuit 46 and grasp the hand position of each hand of the timepiece based on the acquired drive pulse.

The main control circuit 204 controls a supply state of power to the motor control unit 40 by switching a switch SW between an on state and an off state. For example, when a remaining amount of the secondary battery 13 is smaller than a predetermined capacity, the main control circuit 204 may perform control so as to reduce the interval of supplying power to the motor control unit 40 or stop the supply of power to the motor control unit 40. The main control circuit 204 may perform control so as to reduce the interval of supplying power to the motor control unit 40 or stop the supply of power to the motor control unit 40 based on an operation instruction received by the communication circuit 206. The switch SW may be configured with a MOS transistor or the like.

The main control circuit 204 controls operation modes of the timepiece 1 according to an operation result output from the operation unit 70. Here, the operation modes include a time clocking mode (normal operation mode), a chronograph mode, a time adjustment mode, an alarm setting mode, an alarm operation mode, and the like.

The communication circuit 206 exchanges information with the electronic device 90 via the network under the control of the main control circuit 204. The communication circuit 206 transmits and receives instructions and information to and from the electronic device 90, for example, using a Bluetooth (registered trademark) Low Energy (hereinafter, referred to as BLE) standard and a wireless fidelity (Wi-Fi) standard. The communication circuit 206 outputs reception information received from the electronic device 90 to the main control circuit 204 and transmits transmission information output from the main control circuit 204 to the electronic device 90. The transmission information output from the main control circuit 204 is, for example, notification information for notifying that driving could not be performed because the instructed value is outside the movable range.

The crystal oscillator 30 is a passive element used for causing oscillation to be performed at a second frequency. Here, the second frequency is lower than the first frequency, for example, 32 kHz or 64 kHz. 64 kHz is used when the motor 47 rotates in the normal rotation. 32 kHz is used when the motor 47 rotates in the reverse rotation.

A step-down circuit 41 steps down the voltage supplied from the charge control circuit 12 to, for example, 1.57 V, and supplies the stepped down voltage to each component of the motor control unit 40.

The motor control unit 40 operates at the timing of a signal based on the second frequency. The motor control unit 40 is, for example, a motor driver integrated circuit IC. The motor control unit 40 generates drive pulses based on the instruction signal output from the main control circuit 204 and outputs the generated drive pulses to drive the motor 47.

The oscillation circuit 42 is a circuit that realizes an oscillator by being combined with the crystal oscillator 30, and outputs a signal of the generated frequency to the frequency-division circuit 43.

The frequency-division circuit 43 divides the signal of the frequency output from the oscillation circuit 42 into the second frequency and outputs the frequency-divided signal to the pulse generation circuit 46.

The drive control circuit 44 generates a control signal for driving the motor based on the instruction signal for each pointer output from the main control circuit 204, and outputs the generated control signal to the pulse generation circuit 46.

The storing unit 45 stores information necessary for driving the drive control circuit. The information necessary for driving includes, for example, the number of drive pulse generation circuits 46A, . . . connected to the drive control circuit 44, the number of motors 47 to be driven, the number of pointers 60 to be driven, and the like.

The drive pulse generation circuit 46A generates pulse signals M00 and M01 for causing the first motor 47A to normally or reversely rotate, based on the control signal output from the drive control circuit 44. The drive pulse generation circuit 46A drives the first motor 47A according to the generated pulse signals M00 and M01.

The drive pulse generation circuit 46B generates pulse signals M10 and M11 for causing the second motor 47B to normally or reversely rotate, based on the control signal output from the drive control circuit 44. The drive pulse generation circuit 46B drives the second motor 47B according to the generated pulse signals M10 and M11.

The drive pulse generation circuit 46C generates pulse signals M20 and M21 for causing the third motor 47C to normally or reversely rotate, based on the control signal output from the drive control circuit 44. The drive pulse generation circuit 46C drives the third motor 47C according to the generated pulse signals M20 and M21.

Each of the first motor 47A, the second motor 47B, and the third motor 47C is, for example, a stepping motor.

The first motor 47A drives the first pointer 60A via the train wheel 48A by the pulse signals M00 and M01 output from the drive pulse generation circuit 46A. The second motor 47B drives the second pointer 60B via the train wheel 48B by the pulse signals M10 and M11 output from the drive pulse generation circuit 46B. The third motor 47C drives the third pointer 60C via the train wheel 48C by the pulse signals M20 and M21 output from the drive pulse generation circuit 46C.

Each of the train wheel 48A, the train wheel 48B, and the train wheel 48C includes at least one gear.

The first pointer 60A is, for example, an hour hand, and is rotatably supported by the support 50. The second pointer 60B is, for example, a minute hand, and is rotatably supported by the support 50. The third pointer 60C is a second hand, for example, and is rotatably supported by the support 50.

The operation unit 70 includes at least one button or a crown. The operation unit 70 detects the operation result operated by the user and outputs the detected operation result to the main control circuit 204.

In the example illustrated in FIG. 1, an example in which the number of pointers 60 is three and the number of motors 47 is three has been described, but the configuration of the timepiece 1 is not limited thereto. In the timepiece 1, the number of the pointers 60 and the number of the motor 47 may be less than three, or may be four or more, respectively.

Next, an example of information stored in the storing unit 14 will be described.

Figures 2, 3:
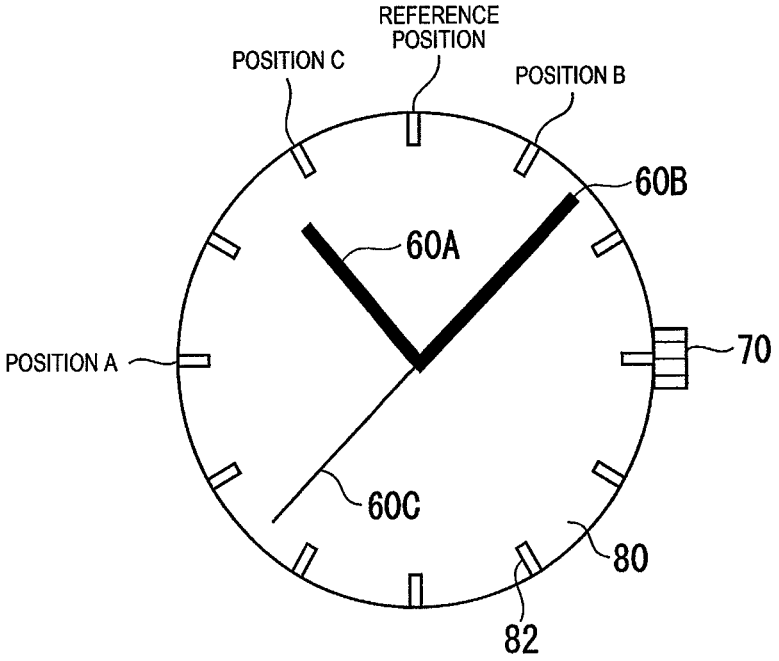
FIG. 2 is a diagram illustrating an example of information stored in a storing unit according to the embodiment.
FIG. 3 is a diagram illustrating an example of a position on a dial according to the embodiment.

FIG. 2 is a diagram illustrating an example of information stored in the storing unit 14 according to the embodiment. As indicated by the reference numeral g1 in FIG. 2, the storing unit 14 stores the movable range, the prohibition area start position, and the prohibition area end position. In the example illustrated in FIG. 2, the movable range is 270° to 30°, the prohibition area start position is 30°, and the prohibition area end position is 270°.

As indicated by the reference numeral g2, the storing unit 14 stores the position of the first pointer 60A, the position of the second pointer 60B, and the position of the third pointer 60C.

Next, the movable range, the prohibition area start position, the prohibition area end position, and the target position will be described with reference to FIGS. 3 and 4.

FIG. 3 is a diagram illustrating an example of a position on a dial 80 according to the embodiment. FIG. 4 is a diagram illustrating an example of the movable range, the prohibition area start position, the prohibition area end position, and the target position according to the embodiment. In FIG. 3, the reference numeral 80 is a dial, and the reference numeral 82 is an index bar or hour scale.

Figure 4:
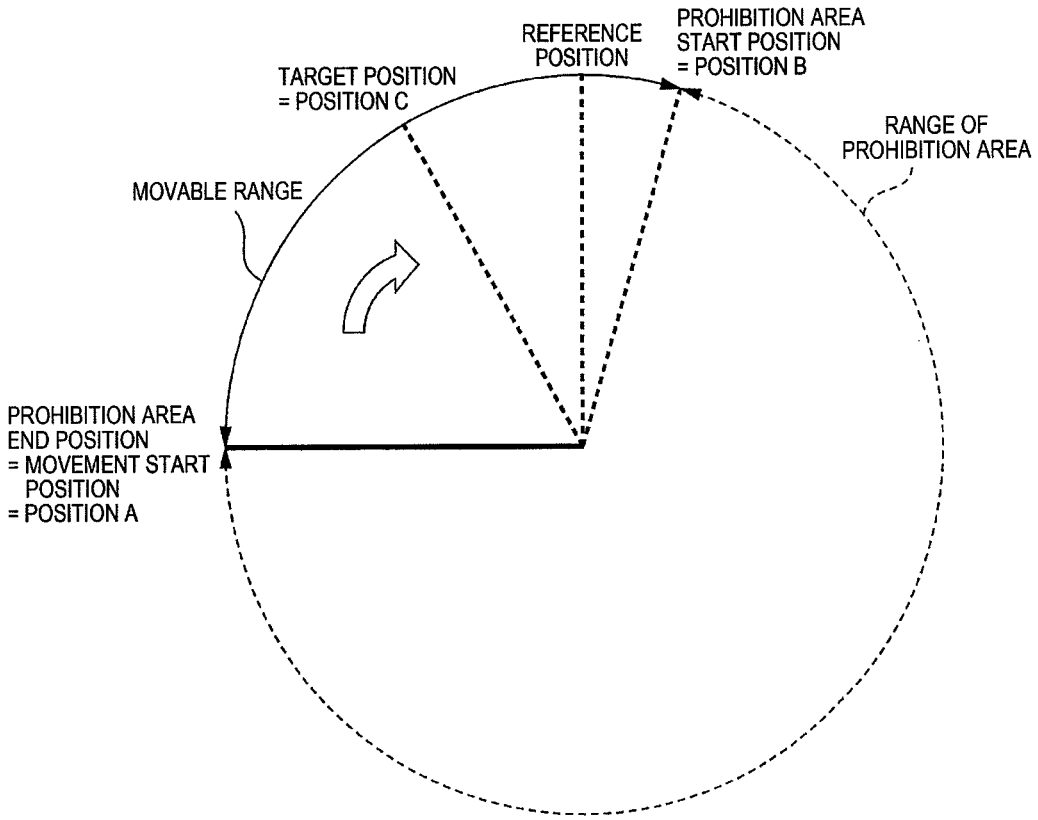
FIG. 4 is a diagram illustrating an example of a movable range, a prohibition area start position, a prohibition area end position, and a target position according to the embodiment.

In the example illustrated in FIGS. 3 and 4, the position of 0 o'clock (12 o'clock; 0°) is the reference position, the position of 1 o'clock (30°) is position B, and the position of 9 o'clock (270°) is position A, and the position of 11 o'clock (330°) is position C. The range (from 270° to 30°) from the position A to the position B is the movable range. The prohibition area start position (30°) is the position B. The prohibition area end position (270°) is the position A. Further, the range (from 30° to 270°) from the position B to the position A is outside the movable range.

In the example illustrated in FIG. 4, the position A is the movement start position of the pointer 60 and the position C is the target position.

Here, an example of information transmitted from the electronic device 90 will be described with reference to FIG. 4.

The electronic device 90 transmits information indicating the range from the position A to the position B as the movable range and information indicating the position C as the target position.

The information representing the position may be, for example, an angle, the number of drives of the motor 47, and the like. The number of drives corresponds to the angle and 0° is 0 step, 90° is 90 steps, 180° is 180 steps, and 270° is 270 steps.

Further, in the embodiment, clockwise (right-hand turn) is referred to as normal rotation and counter clockwise (left-hand turn) is referred to as reverse rotation.

Next, an example of a procedure of processing performed by the timepiece 1 will be described.

Figure 5:
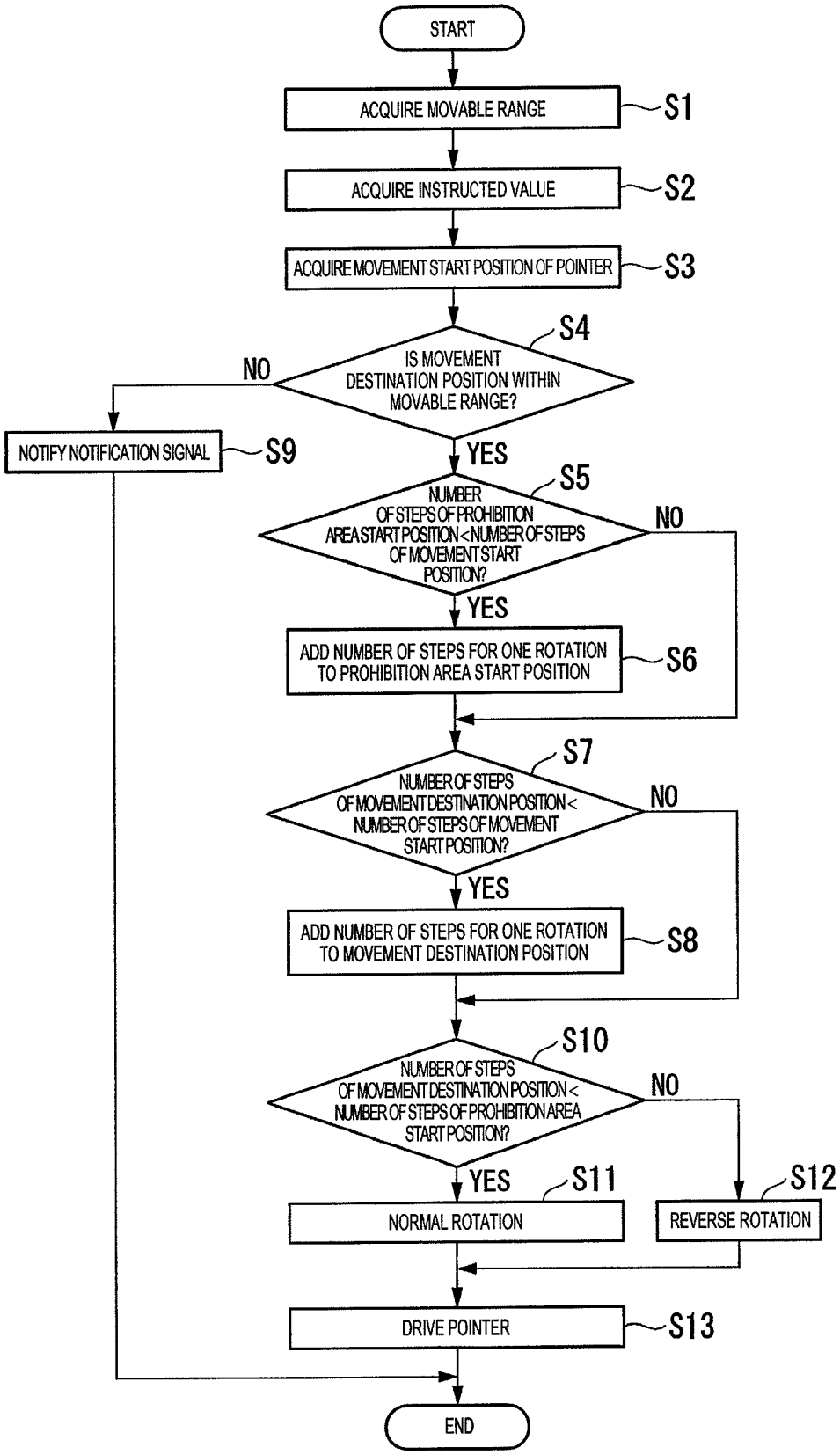
FIG. 5 is a flowchart illustrating an example of a procedure of processing performed by the timepiece according to the embodiment.

FIG. 5 is a flowchart illustrating an example of a procedure of processing performed by the timepiece 1 according to the embodiment. In the example illustrated in FIG. 5, matters that the electronic device 90 transmits the movable range first and then transmits the instructed value are illustrated. It is assumed that the instructed value (which is a target position) transmitted by the electronic device 90 is an indication for the third pointer 60C. In the example, matters that the electronic device 90 transmits the movable range and the instructed value by the number of steps of the motor 47 corresponding to the position are illustrated.

Step S1

The main control circuit 204 acquires information indicating the movable range transmitted by the electronic device 90 via the communication circuit 206. Subsequently, the main control circuit 204 acquires the information indicating the acquired movable range and stores the information indicating the acquired movable range in the storing unit 14. Subsequently, the main control circuit 204 obtains the prohibition area start position and the prohibition area end position using the stored information indicating the movable range and stores the obtained prohibition area start position and prohibition area end position in the storing unit 14. The electronic device 90 may transmit the prohibition area start position and the prohibition area end position as information indicating the movable range. The main control circuit 204 may acquire information indicating the movable range at the first communication with the electronic device 90 and may not acquire the information indicating the movable range at the second and subsequent communication.

Step S2

The main control circuit 204 acquires information indicating an instructed value transmitted by the electronic device 90 via the communication circuit 206. The main control circuit 204 may store information indicating the acquired instructed value in the storing unit 14.

Step S3

The main control circuit 204 acquires the movement start position of the third pointer 60C and stores the acquired movement start position of the third pointer 60C in the storing unit 14.

Step S4

The main control circuit 204 determines whether the target position is within the movable range or not. In a case where it is determined that the target position is within the movable range (YES in Step S4), the main control circuit 204 proceeds to processing of Step S5. In a case where it is determined that the target position is outside the movable range (NO in Step S4), the main control circuit 204 proceeds to processing of Step S9.

Step S5

The main control circuit 204 determines whether the number of steps of the prohibition area start position is less than the number of steps of the movement start position or not. In a case where it is determined that the number of steps of the prohibition area start position is less than the number of steps of the movement start position (YES in Step S5), the main control circuit 204 proceeds to processing of Step S6. In a case where it is determined that the number of steps of the prohibition area start position is equal to or greater than the number of steps of the movement start position (NO in Step S5), the main control circuit 204 sets the prohibition area start position as the post-comparison prohibition area start position, and proceeds to processing of Step S7.

Step S6

The main control circuit 204 corrects the prohibition area start position by adding the number of steps for one rotation (which amounts to 360 steps) to the number of steps of the prohibition area start position and sets the corrected prohibition area start position as the post-correction prohibition area start position. After processing in Step S6, the main control circuit 204 causes processing to proceed to Step S7.

Step S7

The main control circuit 204 determines whether the number of steps of the target position is less than the number of steps of the movement start position or not. In a case where it is determined that the number of steps of the target position is less than the number of steps of the movement start position (YES in Step S7), the main control circuit 204 proceeds to processing of Step S8. In a case where it is determined that the number of steps of the target position is equal to or greater than the number of steps of the movement start position (NO in Step S7), the main control circuit 204 sets the target position as the post-comparison target position and proceeds to processing of Step S10.

Step S8

The main control circuit 204 corrects the target position by adding the number of steps for one rotation (which amounts to 360 steps) to the number of steps of the target position and sets the corrected target position as the post-correction target position. After processing in Step S8, the main control circuit 204 causes processing to proceed to Step S10.

Step S9

Since the third pointer 60C could not be driven, the main control circuit 204 notifies the electronic device 90 via the communication circuit 206 of a notification signal indicating an error. After notifying the notification signal, the main control circuit 204 ends processing.

Step S10

The main control circuit 204 determines whether the number of steps of the post-correction target position is less than the number of steps of the post-correction prohibition area start position or not. In a case where it is determined that the number of steps of the post-correction target position is less than the number of steps of the post-correction prohibition area start position (YES in Step S10), the main control circuit 204 proceeds to processing of Step S11. In a case where it is determined that the number of steps of the post-correction target position is equal to or greater than the number of steps of the post-correction prohibition area start position (NO in Step S10), the main control circuit 204 proceeds to processing of Step S12.

Step S11

The main control circuit 204 determines to drive the third motor 47C in a normal rotation direction. Subsequently, the main control circuit 204 calculates the number of drive steps using the movement start position and the target position. Subsequently, the main control circuit 204 outputs an instruction signal to drive the third motor 47C in the normal rotation direction with the calculated number of drive steps to the drive control circuit 44. Subsequently, the drive control circuit 44 generates a control signal based on an instruction signal which is output from the main control circuit 204 and is for driving the third motor 47C in the normal rotation direction with the number of drive steps, and outputs the generated control signal to the drive pulse generation circuit 46C. After processing in Step S11, the drive control circuit 44 causes processing to proceed to Step S13.

Step S12

The main control circuit 204 determines to drive the third motor 47C in the reverse rotation direction. Subsequently, the main control circuit 204 calculates the number of drive steps using the movement start position and the target position. Subsequently, the main control circuit 204 outputs an instruction signal to drive the third motor 47C in the reverse rotation direction with the calculated number of drive steps to the drive control circuit 44. Subsequently, the drive control circuit 44 generates a control signal based on an instruction signal which is output from the main control circuit 204 and is for driving the third motor 47C in the reverse rotation direction with the number of drive steps, and outputs the generated control signal to the drive pulse generation circuit 46C. After processing in Step S12, the drive control circuit 44 causes processing to proceed to Step S13.

Step S13

The drive pulse generation circuit 46C drives the third motor 47C according to the control signal output from the drive control circuit 44 to drive the third pointer 60C from the movement start position to the target position via the train wheel 48C. After driving the third motor 47C, the drive pulse generation circuit 46C ends processing.

Here, processing of FIG. 5 will be described with reference to FIGS. 6 to 9. In FIGS. 6 to 9, the position A is the movement start position, the position B is the target position, the position C is the prohibition area start position, and the position D is the prohibition area end position. Each of the figures of an area indicated by the reference numeral g12 in FIG. 6, an area indicated by the reference numeral g22 in FIG. 7, an area indicated by the reference numeral g32 in FIG. 8, an area indicated by the reference numeral g33 in FIG. 8, and an area indicated by the reference numeral g42 in FIG. 9 schematically illustrates the position on the straight line by using the reference position as the start position.

Case 1

Figure 6:
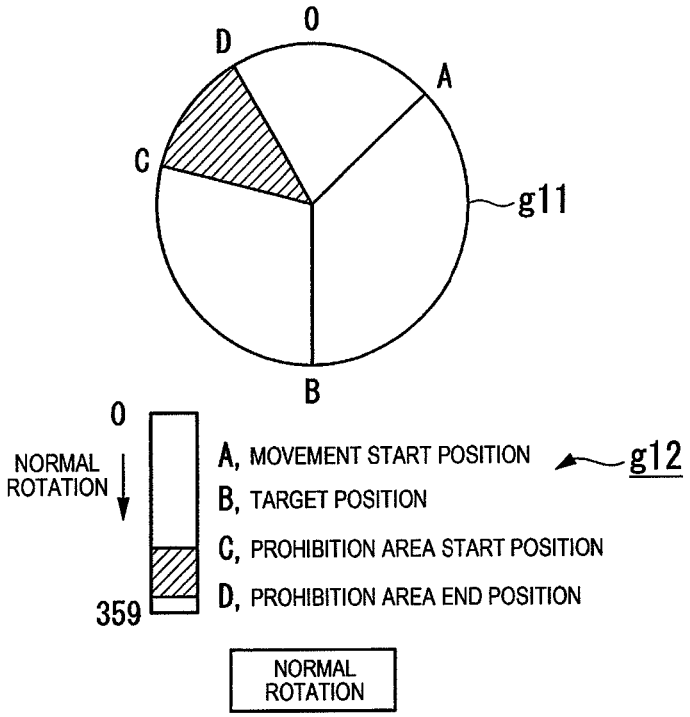
FIG. 6 is a diagram illustrating an example of a movement start position, the target position, the prohibition area start position, and the prohibition area end position in order from a reference position in a normal rotation direction.

FIG. 6 is a diagram illustrating an example of the movement start position, the target position, the prohibition area start position, and the prohibition area end position in order from the reference position in the normal rotation direction. In FIG. 6, as in the area indicated by the reference numeral g11, the position of 0° or 0 step is the reference position, the position of approximately 60° or 60 steps is the position A, and the position of approximately 180° or 180 steps is the position B, the position of approximately 300° or 300 steps is the position C, and the position of approximately 315° or 315 steps is the position D. As indicated by the reference numeral g11, the movable range is a range from the position D to the position C, and the outside of the movable range is a range from the position C to the position D.

In the example of FIG. 6, since the prohibition area start position is a position ahead of the movement start position, that is, the number of steps of the prohibition area start position is equal to or greater than the number of steps of the movement start position, the determination result in Step S5 is NO. Since the target position is a position ahead of the movement start position, that is, the number of steps of the target position is equal to or greater than the number of steps of the movement start position, the determination result in Step S7 is NO. Since the number of steps of the target position is less than the number of steps of the prohibition area start position (YES in Step S10), driving is performed in normal rotation from the movement start position to the target position.

Case 2

Figure 7:
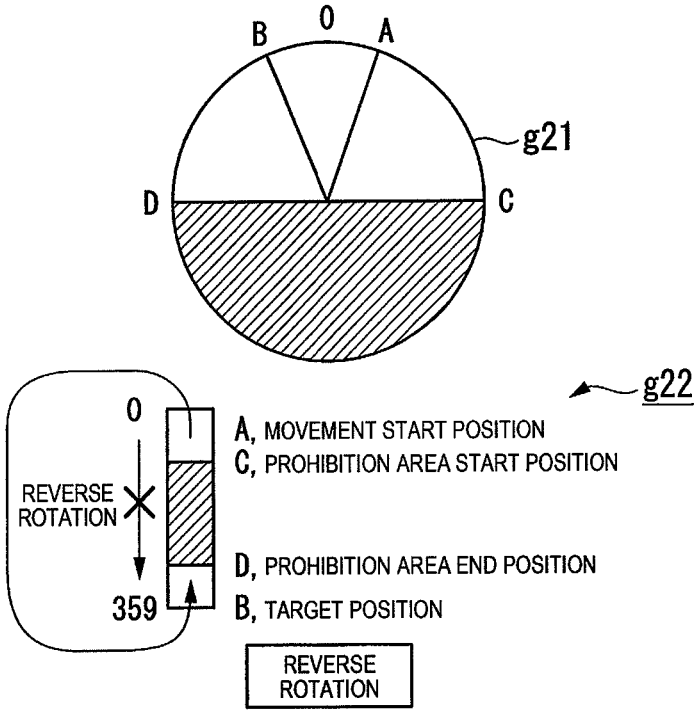
FIG. 7 is a diagram illustrating an example of the movement start position, the prohibition area start position, the prohibition area end position, and the target position in order from the reference position in the normal rotation direction.

FIG. 7 is a diagram illustrating an example of the movement start position, the prohibition area start position, the prohibition area end position, and the target position in order from the reference position in the normal rotation direction. In FIG. 7, as in the area indicated by the reference numeral g21, the position of 0° or 0 step is the reference position, the position of approximately 30° or 30 steps is the position A, and the position of approximately 90° or 90 steps is the position C, the position of approximately 270° or 270 steps is the position D, and the position of approximately 345° or 345 steps is the position B. As indicated by the reference numeral g21, the movable range is a range from the position D to the position C, and the outside of the movable range is a range from the position C to the position D.

As illustrated by the reference numerals g21 and g22, in the example illustrated in FIG. 7, the target position is a position ahead of outside the movable range when viewed from the movement start position in a clockwise direction. Since the pointer 60 cannot be driven outside the movable range, the main control circuit 204 cannot be driven in normal rotation from the movement start position (position A) to the target position (position S).

In the example of FIG. 7, since the prohibition area start position is located at a position ahead of the movement start position, the determination result in Step S5 is NO. Also, since the target position is located at a position ahead of the movement start position, the determination result in Step S7 is NO. Since the number of steps of the target position is equal to or larger than the number of steps of the prohibition area start position (NO in Step S10), driving is performed in reverse rotation from the movement start position to the target position.

Case 3

Figure 8:
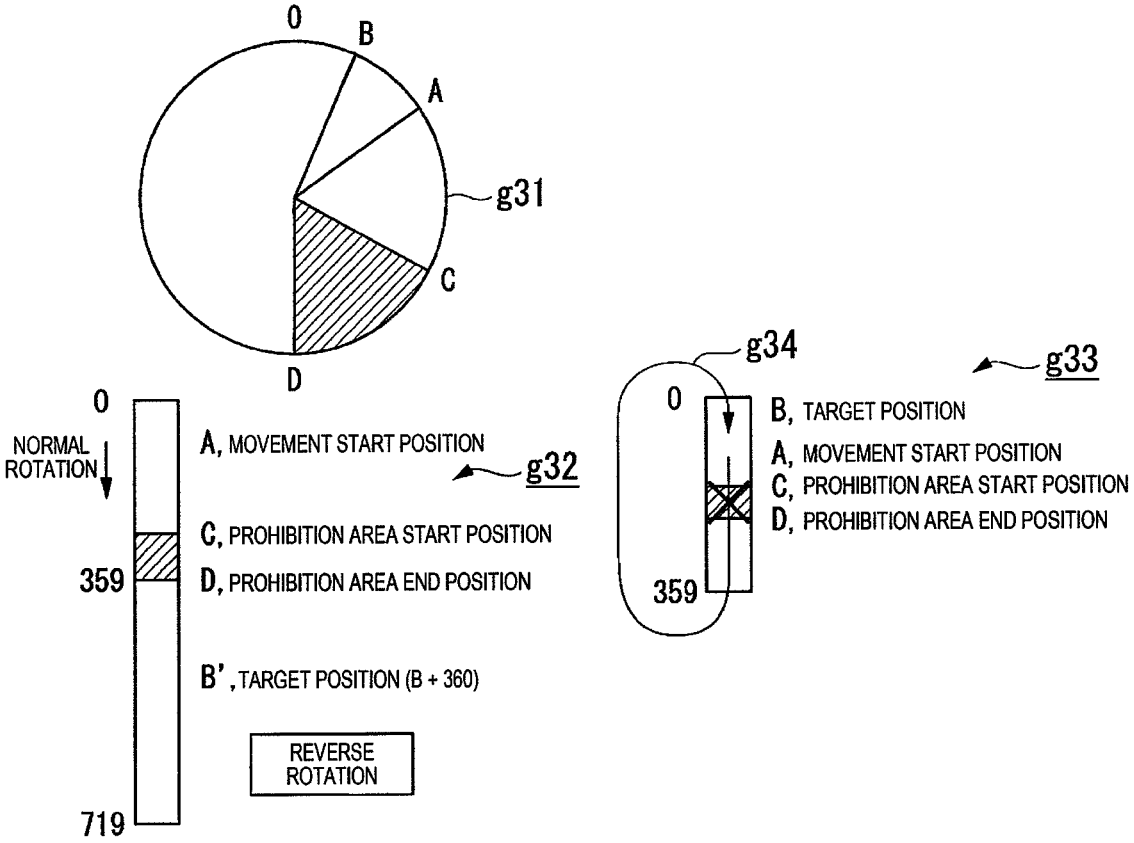
FIG. 8 is a diagram illustrating an example of the prohibition area start position, the prohibition area end position, the target position, and the movement start position in order from the reference position in the normal rotation direction.
Figures 9, 10, 11:
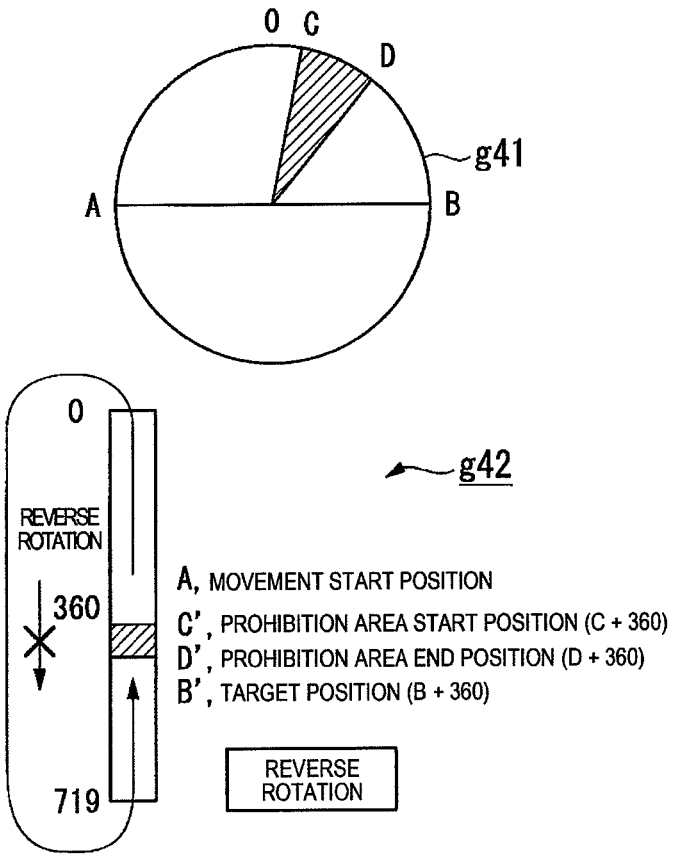
FIG. 9 is a diagram illustrating an example of the target position, the movement start position, the prohibition area start position, and the prohibition area end position in order from the reference position in the normal rotation direction.
FIG. 10 is a diagram illustrating an example of transmission information transmitted by an electronic device according to the embodiment.
FIG. 11 is a diagram illustrating an example of transmission information transmitted by the electronic device in a case where two pointers are driven.

FIG. 8 is a diagram illustrating examples of the target position, the movement start position, the prohibition area start position, and the prohibition area end position in order from the reference position in the normal rotation direction. In FIG. 8, as in the area indicated by the reference numeral g31, the position of 0° or 0 step is the reference position, the position of approximately 30° or 30 steps is the position B, and the position of approximately 60° or 60 steps is the position A, the position of approximately 120° or 120 steps is the position C, and the position of approximately 180° or 180 steps is the position D. As indicated by reference numeral g31, the movable range is a range from the position D to the position C, and the outside of the movable range is a range from the position C to the position D.

In the example of FIG. 8, since the prohibition area start position is located at a position ahead of the movement start position, the determination result in Step S5 is NO. Since the target position is located at a position before the movement start position, that is, the number of steps of the target position is less than the number of steps of the movement start position, the determination result in Step S7 is YES. For that reason, 360 steps are added to the target position. When the post-correction target position (position B') to which 360 steps have been added is compared with the prohibition area start position in Step S10, the number of steps of the target position is equal to or greater than the number of steps of the prohibition area start position (NO in Step S10) and thus, driving is performed in reverse rotation from the movement start position to the target position. As indicated by the reference numeral g33, since an angle of the target position is smaller than an angle of the movement start position and as illustrated by the arrow g34, since outside of the movable range exists in a movement range from the movement start position to the target position, failure occurs when determining the driving direction.

In the example of FIG. 8, since the prohibition area start position is located at a position before the movement start position, that is, the number of steps of the prohibition area start position is less than the number of steps of the movement start position, the determination result in Step S5 is YES. For that reason, 360 steps are added to the prohibition area start position. As illustrated in FIG. 8, in a case where the number of steps of the prohibition area end position is less than the number of steps of the movement start position, the main control circuit 204 may also add 360 steps to the prohibition area end position. Since the target position is located at a position before the movement start position, that is, the number of steps of the target position is less than the number of steps of the movement start position, the determination result in Step S7 is YES. For that reason, 360 steps are added to the target position. Since the number of steps of the post-correction target position (position B') to which the 360 steps are added is equal to or greater than the number of steps of the post-correction prohibition area start position (position C') to which 360 steps are added (NO in Step S10), driving is performed in reverse rotation from the movement start position to the target position.

Case 4

FIG. 9 is a diagram illustrating an example of the prohibition area start position, the prohibition area end position, the target position, and the movement start position in order from the reference position in the normal rotation direction. In FIG. 9, as in the area indicated by the reference numeral g41, the position of 0° or 0 step is the reference position, the position of approximately 15° or 15 steps is the position C, and the position of approximately 45° or 45 steps is the position D, the position of approximately 90° or 90 steps is the position B, and the position of approximately 270° or 270 steps is the position A. As indicated by the reference numeral g31, the movable range is a range from the position D to the position C, and the outside of the movable range is a range from the position C to the position D.

As illustrated by the reference numerals g41 and g42, in the example illustrated in FIG. 9, the target position is a position ahead of the movable range when viewed from the movement start position in a clockwise direction and is a position which straddles the reference position when viewed in a clockwise direction. Also, in this case, the main control circuit 204 cannot be driven in normal rotation from the movement start position to the target position. Furthermore, in the example illustrated in FIG. 9, the prohibition area start position, the prohibition area end position, and the target position are located ahead of the reference position with respect to the movement start position.

In the example of FIG. 9, since the prohibition area start position is located at a position before the movement start position, that is, the number of steps of the prohibition area start position is less than the number of steps of the movement start position, the determination result in Step S5 is YES. For that reason, 360 steps are added to the prohibition area start position. As illustrated in FIG. 9, in a case where the number of steps of the prohibition area end position is less than the number of steps of the movement start position, the main control circuit 204 may also add 360 steps to the prohibition area end position. Since the target position is located at a position before the movement start position, that is, the number of steps of the target position is less than the number of steps of the movement start position, the determination result in Step S7 is YES. For that reason, 360 steps are added to the target position. Since the number of steps of the post-correction target position (position B') to which the 360 steps are added is equal to or greater than the number of steps of the post-correction prohibition area start position (position C') to which 360 steps are added (NO in Step S10), driving is performed in reverse rotation from the movement start position to the target position.

As in steps S6 and S8 in FIG. 5, the condition for adding the movable range (360° or 360 steps) of the pointer 60 corresponds to a case where the pointer 60 straddles the reference position in a case where the pointer 60 is caused to move from the movement start position to the target position which is the movement destination in normal rotation as in the case 3 and the case 4 described above. That is, when viewed from the reference position, in a case where the prohibition area start position or the target position straddles the reference position in the normal rotation direction with respect to the movement start position, the main control circuit 204 adds 360° or 360 steps which is a range at which movement of the pointer 60 is allowed.

For that reason, in the embodiment, when it is determined whether driving to the target position is normal rotation or reverse rotation, in the following case, it is regarded as being at the position obtained by adding the driving step (360 steps, that is, 360°) for one rotation.

I. When viewed in the clockwise direction, the prohibition area start position is located closer to the reference position side than the movement start position (that is, the angle of the prohibition area start position is smaller than the angle of the movement start position)

II. When viewed in the clockwise direction, the target position is located closer to the reference position side than the current position (that is, angle of the target position is smaller than angle of the movement start position)

With this, according to the embodiment, it is possible to determine whether to drive in normal rotation or reverse rotation in order to drive so that the pointer 60 does not pass through outside the movable range.

In the example illustrated in FIG. 5, the example in which the electronic device 90 first transmits the movable range and then transmits the instructed value has been described, but the invention is not limited thereto. As illustrated in FIG. 10, the electronic device 90 may transmit the movable range and the instructed value in a pair. FIG. 10 is a diagram illustrating an example of transmission information transmitted by the electronic device 90 according to the embodiment. In the example illustrated in FIG. 10, the movable range and the instructed value are included in the transmission information, but other information may be included in the transmission information. As such, the electronic device 90 transmits the movable range and the instructed value in a pair so as to make it possible to indicate the movable range of the pointers 60 and the target position, regardless of the movable range, the movement start position, and the target position before transmitting the transmission information.

In the example illustrated in FIG. 5, the example in which only one pointer 60 is driven according to transmission information from the electronic device 90 has been described, but the number of the pointers 60 driven by the timepiece 1 according to the transmission information from the electronic device 90 may be one or more.

FIG. 11 is a diagram illustrating an example of transmission information transmitted by the electronic device 90 in a case where the two pointers 60 are driven. In the example illustrated in FIG. 11, the movable range and the instructed value are transmitted in a pair. As illustrated in FIG. 11, the electronic device 90 transmits a pair of the movable range and the instructed value to the timepiece 1 according to the number of the pointers 60 to be driven.

Similarly as in FIG. 5, the electronic device 90 may first transmit the movable range of the first pointer and the movable range of the second pointer and then, transmit the instructed value of the first pointer and the instructed value of the second pointer.

In the example described above, the example in which the electronic device 90 transmits the movable range of the pointer 60 has been described, but the invention is not limited thereto. In the timepiece 1, the movable range may be stored in the storing unit 14 and the storing unit 45 in advance.

FIG. 12 is a diagram illustrating another example of information stored in the storing unit 14 and the storing unit 45 according to the embodiment. In the example illustrated in FIG. 12, three types of preset values are stored for one pointer 60. In such a case, the electronic device 90 may transmit information which indicates which preset value is to be used and an instructed value in a pair to the timepiece 1. For example, in a case where the first preset value is used, the electronic device 90 may transmit information indicating a first preset value instead of the movable range in FIG. 5. In a case where such a preset value is stored only by the timepiece 1, the timepiece 1 may transmit information of the stored preset value to the electronic device 90.

In the timepiece 1, the movable range of each of the plurality of pointers 60 may be stored in the storing unit 14 and the storing unit 45. For example, the storing unit 14 and the storing unit 45 may store the movable range, the prohibition area start position, and the prohibition area end position for each pointer 60.

In the example described above, the example in which the electronic device 90 transmits information on the movable range of the pointer 60 as information on a movable range, or the timepiece 1 stores the information, but the invention is not limited thereto. The information on the movable range may be information on a range of an area where movement of the pointer 60 is prohibited. The information on the range of the area where movement of the pointer 60 is prohibited is the range outside the movable range, or the prohibition area start position and the prohibition area end position.

In FIGS. 3, 4, and 6 to 9, although the example in which the pointer 60 can move in the circular direction has been described, the movement of the pointer 60 may be, for example, a straight line direction as illustrated in FIG. 13.

FIG. 13 is a diagram illustrating an example of another movement direction of the pointer 60. In the example illustrated in FIG. 13, the pointer 60 is attached so as to be movable in the lateral direction. In FIG. 13, the movable range is from 240 steps to 359 steps and from 0 step to 180 steps. The reference position is 0. A range outside the movable range is from 181 steps to 240 steps, the prohibition area start position is 181 steps, and the prohibition area end position is 240 steps. In FIG. 13, for example, in a case where the movement start position of the pointer 60 is 100 steps and the target position is 300 steps, since the range outside the movable range is from 181 steps to 240 steps, the main control circuit 204 calculates the movement direction by adding 360 steps which are the step count from an end to the end.

Although FIG. 13 illustrates an example of the horizontal direction, the movement direction may be a vertical direction, an oblique direction, or the like.

Here, an example of a case where the electronic device 90 further transmits the movable range when the movable range of the pointer 60 is regulated in advance.

FIG. 14 is a diagram illustrating an example of a case where the electronic device 90 further transmits the movable range when the movable range of the pointer 60 is regulated in advance. Regulation of the movable range of the pointer 60 may be made by the main control circuit 204 (regulation unit) based on regulation by a physical stopper (regulation unit) and a movable range in which a range capable of being driven by the motor 47 is stored in the storing unit 45. The physical stopper may be, for example, a shaft of another pointer 60 or the like.

In FIG. 14, a range indicated by the reference numeral g51 is a movable range that is mechanically limited in advance and is, for example, a position from approximately 8 o'clock to approximately 2 o'clock in clockwise. A range indicated by the reference numeral g53 is the movable range transmitted by the electronic device 90 and is, for example, a position from approximately 10 o'clock to approximately 4 o'clock in clockwise.

In such a case, the main control circuit 204 determines an area indicated by the reference numeral g52, in which the range indicated by the reference numeral g51 and the range indicated by the reference numeral g53 overlap each other, as the movable range (for example, a range from position of approximately 10 o'clock to position of approximately 2 o'clock). In the example illustrated in FIG. 14, the main control circuit 204 determines, for example, the range from the position of approximately 10 o'clock to the position of approximately 2 o'clock as the movable range.

As described above, according to the embodiment, it is possible to properly drive the hand according to a drive request to the pointer within a predetermined range. With this, according to the embodiment, it is possible to improve followability to continuous drive requests. According to the embodiment, it is possible to prevent the pointer from being operated to move beyond the movable range in response to the drive request.

In the embodiment, an example in which the main control circuit 204 generates the instruction signal for driving the motor based on the movable range and the instructed value transmitted by the electronic device 90 has been described, but the drive control circuit 44 may generate an instruction signal for driving the motor. In this case, the main control circuit 204 may output the movable range and the instructed value transmitted by the electronic device 90 to the drive control circuit 44. In this case, the drive control circuit 44 may store the movable range and the instructed value in the storing unit 45 in a case where the movable range and the instructed value are output from the main control circuit 204. The drive control circuit 44 may determine whether to rotate the pointer 60 in normal rotation or reverse rotation according to the stored movable range, the instructed value, and the position of the hand to be grasped. The drive control circuit 44 may generate a control signal for driving the motor based on the determined result and output the generated control signal to the pulse generation circuit 46. The storing unit 45 may store the movable range and the instructed value output from the main control circuit 204. The storing unit 45 may store the movable range of the pointer 60 in advance. Then, regulation of the movable range of the pointer 60 may be made by the drive control circuit 44 (regulation unit) based on regulation by the physical stopper (regulation unit) and the movable range in which a range capable of being driven by the motor 47 is stored in the storing unit 45.

In the example illustrated in FIG. 1, the example in which the timepiece 1 includes the main control circuit 204 and the drive control circuit 44 has been described, but the main control circuit 204 and the drive control circuit 44 may be integrally configured.

The timepiece 1 may further include a display unit such as a liquid crystal display, a display drive circuit, a buzzer, a sensor such as an acceleration sensor, and the like.

Here, the conventional driving method example is compared with the driving method of the embodiment.

In the conventional driving method, first, the electronic device 90 transmits the target position and the rotation direction of the pointer to the timepiece. It is assumed that the movable prohibition area is an area from the position of 6 o'clock to the position of 12 o'clock in clockwise. It is assumed that the movement start position is the position of 0 o'clock. The electronic device 90 transmits the position of 6 o'clock as the first target position to the timepiece. Furthermore, the electronic device 90 transmits the position of 3 o'clock as the second target position to the timepiece. As such, in a case where the second target position (position of 3 o'clock) is instructed after instructing the first target position (position of 6 o'clock), the electronic device 90 does not grasp whether the position of the pointer is located at a side (from 0 o'clock to 3 o'clock) before the second target position (position of 3 o'clock) or located at a side (from 3 o'clock to 6 o'clock) ahead of the second target position (position of 3 o'clock). For that reason, when the second target position is transmitted to the timepiece, the electronic device 90 cannot instruct the rotation direction of the pointer. Here, if the position of the pointer is grasped by the counter included in the timepiece and the grasped position of the pointer is transmitted to the electronic device 90, the electronic device 90 needs time to receive the information. That is, since loss time (time lag due to communication) from the time at which information is transmitted to the transmission source to the time at which the transmission source receives the information occurs, the transmission source cannot grasp a timely hand position of the timepiece. In this state, if the electronic device 90 instructs a reverse rotation direction which is inaccurate, the arrival at the target position is delayed and followability is impaired. Furthermore, in some cases, there is a possibility that operation by which the pointer moves to the movable prohibition area and which does not meet product specifications occurs.

On the other hand, in the embodiment, first, the electronic device 90 transmits the movable range to the timepiece, so that the movable range of the pointer 60 is set by transmission information from the electronic device 90. That is, the electronic device 90 grasps the movable range and the movable prohibition area of the pointer 60. Since the timepiece 1 determines the accurate rotation direction with its own device, the electronic device 90 designates the target position or the target angle to the timepiece 1 without instructing the rotation direction. In the embodiment, since the rotation direction is determined and is driven at the timepiece 1, the electronic device 90 transmits the second target position (position of 3 o'clock) which is the latest value without waiting for completion of the movement to the first target position (position of 6 o'clock) previously transmitted. That is, in the embodiment, the timepiece 1 side moves the pointer 60 to the received second target position even before the pointer 60 reaches the first target position after receiving the first target position. With this, according to the embodiment, it is possible to optimally drive and control the pointer 60 in response to the drive request to the pointer 60 within a predetermined range. According to the embodiment, since the pointer 60 can always be moved to the latest value without waiting for the completion of the movement of the pointer 60 to the previously received target position, it is possible to improve followability in response to a continuous driving request to the pointer 60. That is, it is possible to follow and display the moving speed or the like even an instructed value of the moving speed or the like at which the value changes quickly. According to the embodiment, the movable range is transmitted from the outside so as to make it possible to flexibly change the display position and display contents with change of the transmission source. According to the embodiment, since the electronic device 90 grasps the movable prohibition area of the timepiece 1, there is no concern that an instruction to move the pointer 60 to the movable prohibition area is transmitted. Since the timepiece 1 grasps the position and rotation direction of the pointer 60, the time device determines the rotation direction in which the pointer rotates avoiding the movable prohibition area according to the instruction from the electronic device 90 and drives the pointer 60.

In the example of FIG. 3 and the like described above, an example in which the pointer 60 displaying the time according to the transmission information transmitted by the electronic device 90 is driven has been described, but the invention is not limited thereto. The pointer 60 driven according to the transmission information transmitted by the electronic device 90 may also be provided exclusively. The pointer 60 driven according to the transmission information transmitted by the electronic device 90 may be a pointer such as a retrograde in which the movable range is limited in advance.

A program for realizing all or some of the functions of the main control circuit 204 and the drive control circuit 44 of the invention may be recorded in a computer-readable recording medium and the program recorded in the recording medium may be read into a computer system to be executed to perform processing to be performed by the main control circuit 204 and the drive control circuit 44. The "computer system" referred to here includes an OS and hardware such as a peripheral device. The "computer system" also includes a WWW system having website providing environment (or display environment). The "computer-readable recording medium" refers to a storage device such as a flexible disk, a magneto-optical disk, a portable medium such as a ROM and a CD-ROM, and a hard disk built in the computer system. Furthermore, the "computer-readable recording medium" refers to a medium holding a program for a certain period of time such as a volatile memory (RAM) within the computer system which serves as a server or a client in a case where the program is transmitted via a network such as the Internet or a communication line such as a telephone line.

The program described above may be transmitted from the computer system in which the program is stored in a storage device or the like to another computer system via a transmission medium or by a transmission wave in the transmission medium. Here, the "transmission medium" for transmitting the program refers to a medium having a function of transmitting information such as a network (communication network) such as the Internet and a communication link (communication line) such as a telephone line. The program described above may be for realizing a portion of the functions described above. Furthermore, the program may be a so-called difference file (differential program) which can realize the function described above by a combination with a program previously recorded in the computer system.

While aspects for embodying the invention have been described using the embodiments, the invention is not limited to those embodiments at all, and various modifications and substitutions may be made thereto without departing from the scope of the invention.

What is claimed is:

1. A timepiece comprising:

a movable pointer;

an acquisition unit which acquires information on a movable range corresponding to at least a portion of a movable range of the movable pointer and acquires information indicating a target position to which the pointer is to be moved;

a control unit configured to compare the target position with the movable range and determine a movement direction of the pointer based on the comparison result so that the pointer can move in the determined movement direction to the target position without passing outside the movable range; and a drive unit which drives the pointer in the determined movement direction to the target position, wherein the control unit is configured to compare a prohibition area start position which is an end position of the movable range with the movement start position, correct the prohibition area start position by adding the movable range of the pointer to the prohibition area start position, set the prohibition area start position as a post-comparison prohibition area start position in a case where the prohibition area start position is a position before the movement start position as a result of the comparison, and set the prohibition area start position as the post-comparison prohibition area start position without correcting the prohibition area start position in a case where the prohibition area start position is a position ahead of the movement start position as a result of the comparison, compare the target position and the movement start position, correct the target position by adding the movable range of the pointer to the target position, set the target position as a post-comparison target position in a case where the target position is a position before the movement start position as a result of the comparison, and set the target position as the post-comparison target position without correcting the target position in a case where the target position is a position ahead of the movement start position as a result of the comparison, and compare the post-comparison target position with the post-comparison prohibition area start position, determine that the post-comparison target position is to be moved in a normal direction in a case where the post-comparison target position is a position before the post-comparison prohibition area start position as a result of the comparison, and determine that the post-comparison target position is to be moved in a reverse direction in a case where the post-comparison target position is a position ahead of the post-comparison prohibition area start position as a result of the comparison.

2. The timepiece according to claim 1, wherein when at least one of one end and the other end of the movable range is included between a movement start position and the target position in a predetermined one direction from the movement start position, the control unit determines the movement direction as a movement direction to another direction different from the predetermined one direction.

3. The timepiece according to claim 1, wherein the control unit determines the movement direction within a range obtained by adding the movable range of the pointer with respect to the position in a case where at least one of the one end of the movable range, the other end of the movable range, and the target position straddles a reference position when viewed from the movement start position when it is intended to move the pointer in a predetermined one direction from the movement start position.

4. The timepiece according to claim 1, wherein the acquisition unit acquires a first target position which is the target position and a second target position which is requested after the first target position and is the target position, and the control unit controls the drive unit so that the pointer is driven based on the second movement direction before the pointer reaches the first target position, based on a first movement direction calculated based on the first target position and a second movement direction calculated based on the second target position.

5. The timepiece according to claim 1, wherein the acquisition unit acquires information in which the target position and the movable range are combined.

6. The timepiece according to claim 1, further comprising:

a regulation unit which regulates a rotation range of the pointer, wherein the acquisition unit is a communication unit which transmits and receives information to and from an electronic device having a communication function, and the control unit determines a range in which the movable range acquired by the acquisition unit overlaps a rotation range regulated by the regulation unit as a movable range of the pointer.

7. The timepiece according to claim 1, wherein the control unit notifies a notification signal in a case where the target position is outside the movable range.

8. The timepiece according to claim 1, further comprising:

a storing unit which stores a plurality of the movable ranges, wherein the acquisition unit is a communication unit which transmits and receives information to and from an electronic device having a communication function and acquires a selection signal indicating whether the movable range is one of the plurality of movable ranges, and the control unit selects one of the plurality of movable ranges according to the selection signal.

9. A timepiece system comprising:

a timepiece which includes a movable pointer, a communication unit which acquires information on a movable range corresponding to at least a portion of a movable range of the movable pointer and acquires information indicating a target position to which the pointer is to be moved, a control unit configured to compare the target position with the movable range and determine a movement direction of the pointer based on the comparison result so that the pointer can move in the determined movement direction to the target position without passing outside the movable range, and a drive unit which drives the pointer in the determined movement direction; and an electronic device provided with a communication unit which transmits information indicating the movable range and information indicating the target position, wherein the control unit is configured to compare a prohibition area start position which is an end position of the movable range with the movement start position, correct the prohibition area start position by adding the movable range of the pointer to the prohibition area start position, set the prohibition area start position as a post-comparison prohibition area start position in a case where the prohibition area start position is a position before the movement start position as a result of the comparison, and set the prohibition area start position as the post-comparison prohibition area start position without correcting the prohibition area start position in a case where the prohibition area start p position ahead of the movement start position as a result of the comparison, compare the target position and the movement start position, correct the target position by adding the movable range of the pointer to the target position, set the target position as a post-comparison target position in a case where the target position is a position before the movement start position as a result of the comparison, and set the target position as the post-comparison target position without correcting the target position in a case where the target position is a position ahead of the movement start position as a result of the comparison, and compare the post-comparison target position with the post-comparison prohibition area start position, determine that the post-comparison target position is to be moved in a normal direction in a case where the post-comparison target position is a position before the post-comparison prohibition area start position as a result of the comparison, and determine that the post-comparison target position is to be moved in a reverse direction in a case where the post-comparison target position is a position ahead of the post-comparison prohibition area start position as a result of the comparison.

10. The timepiece system according to claim 9, wherein the timepiece further includes a storing unit which stores a plurality of movable ranges, the control unit of the timepiece transmits the plurality of movable ranges stored by the storing unit to the electronic device via the communication unit, and the electronic device selects a desired movable range from among the plurality of movable ranges received from the timepiece and transmits the selected movable range to the timepiece.

11. A method of controlling a timepiece comprising:

acquiring information on a movable range corresponding to at least a portion of a movable range of a movable pointer by an acquisition unit;

acquiring information indicating a target position to which the pointer is to be moved by the acquisition unit;

comparing, by a control unit, the target position and the movable range and determining a movement direction of the pointer based on the comparison result so that the pointer can move in the determined movement direction to the target position without passing outside the movable range; and driving, by a drive unit, the pointer in the determined movement direction to the target position, wherein the control unit is configured to compare a prohibition area start position which is an end position of the movable range with the movement start position, correct the prohibition area start position by adding the movable range of the pointer to the prohibition area start position, set the prohibition area start position as a post-comparison prohibition area start position in a case where the prohibition area start position is a position before the movement start position as a result of the comparison, and set the prohibition area start position as the post-comparison prohibition area start position without correcting the prohibition area start position in a case where the prohibition area start position is a position ahead of the movement start position as a result of the comparison, compare the target position and the movement start position, correct the target position by adding the movable range of the pointer to the target position, set the target position as a post-comparison target position in a case where the target position is a position before the movement start position as a result of the comparison, and set the target position as the post-comparison target position without correcting the target position in a case where the target position is a position ahead of the movement start position as a result of the comparison, and compare the post-comparison target position with the post-comparison prohibition area start position, determine that the post-comparison target position is to be moved in a normal direction in a case where the post-comparison target position is a position before the post-comparison prohibition area start position as a result of the comparison, and determine that the post-comparison target position is to be moved in a reverse direction in a case where the post-comparison target position is a position ahead of the post-comparison prohibition area start position as a result of the comparison.

* * * * *